US007302819B2

(12) United States Patent
Lennhoff

(10) Patent No.: US 7,302,819 B2
(45) Date of Patent: Dec. 4, 2007

(54) DEVICE FOR ACTUATING A LOCK ON A VEHICLE DOOR

(75) Inventor: Ralf Lennhoff, Hagen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/913,951

(22) Filed: Aug. 6, 2004

(65) Prior Publication Data

US 2005/0034495 A1 Feb. 17, 2005

(30) Foreign Application Priority Data

Aug. 8, 2003 (DE) ..... 103 36 764

(51) Int. Cl.
*E05B 9/04* (2006.01)

(52) U.S. Cl. ..... 70/371; 70/370; 70/448; 70/451; 70/466; 292/336.3

(58) Field of Classification Search ..... 70/370–371, 70/448, 451, 466; 292/348, 350, 336.3
See application file for complete search history.

(56) References Cited

U.S. PATENT DOCUMENTS 2,040,258 A * 5/1936 Jacobi ..... 70/370
2,629,248 A * 2/1953 Burdick ..... 70/370
4,293,256 A * 10/1981 Pamer ..... 411/11
5,297,405 A * 3/1994 Manning et al. ..... 70/370
6,401,302 B1 * 6/2002 Josserand et al. ..... 292/336.3
6,415,636 B1 * 7/2002 Fukumoto et al. ..... 70/370
6,494,066 B2 * 12/2002 Muneta ..... 70/370
6,523,379 B2 * 2/2003 Teskey ..... 70/370
6,550,295 B2 * 4/2003 Hubner ..... 70/370
6,672,633 B2 * 1/2004 Nomura et al. ..... 292/336.3
6,748,775 B1 * 6/2004 Bucker et al. ..... 70/370

FOREIGN PATENT DOCUMENTS

DE 3030519 2/1982
DE 199 50 172 A1 4/2001

* cited by examiner

*Primary Examiner*—Jennifer H. Gay
*Assistant Examiner*—Christopher Boswell
(74) *Attorney, Agent, or Firm*—Friedrich Kueffner

(57) ABSTRACT

A device for actuating a lock on a vehicle door has a support mounted on a vehicle door. A lock cylinder mount, or a decoy, is mounted on the support. A screw secures the mount when mounted on the support. The mount has a shoulder engaging a counter shoulder of the support at least partially in the mounting position of the mount. The screw has an actuating end for moving the screw into a release position and a locking position. In the release position, the mount is removable from and mountable on the support. In the locking position, the mount is secured. The mount has a threaded receptacle for the screw so that the screw is part of the mount. The support has a screw support surface against which the actuating end of the screw rests in the locking position of the screw for securing the mount.

18 Claims, 7 Drawing Sheets

VIII

IX

DEVICE FOR ACTUATING A LOCK ON A VEHICLE DOOR

BACKGROUND OF THE INVENTION

1. Field of the Invention

The invention relates to a device for actuating a lock on a vehicle door, wherein the term vehicle door includes any type of lid, hatch, flap, hood and the like on a vehicle. The device comprises: a support to be stationarily mounted on the door; a mount mountable on the support and configured either as a lock cylinder mount or as a lock cylinder-free mount (decoy); a shoulder on the mount that engages at least partially in the secured mounting position of the mount a counter shoulder provided on the support; a screw for securing the mounting position of the mount on the support; and an actuating end on the screw for a screwing adjustment of two end positions, i.e., a release position in which the mount can be mounted on or demounted from the support and a locking position in which the mount is secured in its mounting position on the support. In this configuration, the support to be mounted on the door not only supports the handle but also receives a lock cylinder mount or a lock cylinder decoy. The handle upon actuation acts on a lock in the door or the flap etc.; this holds true also for a lock cylinder when it is actuated by a matching key. These two alternatives, i.e., the lock cylinder mount and the lock cylinder decoy, will be referred to in the following simply as "mount".

2. Description of the Related Art

The devices of this kind are designed to enable, on the one hand, an easy and reliable mounting of the mount within the receptacle of the support and, on the other hand, to secure the mount after having been mounted properly on the support in a reliable way. For this purpose, the mount of the device has a shoulder that, at least in the secured mounting position of the mount, engages at least partially a counter shoulder provided on the support. For securing the mounting position in the mount, a screw is used whose actuating end is accessible from the narrow side of the door.

In a known device of the aforementioned kind, disclosed in German patent DE 30 30 519 C, the screw is a component of the support. The support has a threaded receptacle in which the screw is received. The inner end of the screw serves for securing the mount. Before mounting, the support is already stationarily secured on the inner side of the door and the mount is inserted from the exterior through an opening provided in the outer door panel of the door and is then mounted on the support by a mounting movement. During this mounting process, the screw is unscrewed out of the threaded receptacle to such an extent that the mounting movement for mounting the mount can be carried out; this mounting movement is comprised of an insertion phase and a subsequent displacement phase that is parallel to the insertion position. During this displacement phase of the mounting movement, the shoulder of the mount moves into a position behind the aforementioned counter shoulder on the support. This engaged position of the shoulder and counter shoulder is secured by the screw in that the screw is threaded into the threaded receptacle to such an extent that its inner end is supported on the sidewall of the mount. In this way, a movement reversing the mounting movement for demounting the mount is blocked. The movement of the mount in a reverse movement relative to the mounting movement is prevented by the tightened screw.

There are also devices where the securing action for the mounted mount on the support is not a direct action but is achieved indirectly, as disclosed in German patent application DE 199 50 172 A1. In this case, a slide is slidably received in guides of the support so as to be slidable in parallel. The slide has a threaded receptacle for a screw that is rotatably supported with its actuating end in an axially fixed position within the support. Before beginning the mounting process of the mount, the screw with its threaded inner end is screwed as far as possible into the threaded receptacle of the slide so that the slide is initially in a position remote from the mount. Then, the mount is inserted from the exterior side of the door into the support provided on the inner side of the door. When the screw is turned such that its threaded inner end is moved out of the threaded receptacle of the slide, the slide, because of the axially fixed rotational support of the screw, is moved more and more against the mount and the mount is parallel displaced within the support. This movement of the slide causes not only the mount to be displaced; moreover, the shoulders on the mount are moved behind the counter shoulders of the support and noses provided on the slide are moved into notches provided on the mount. The securing action is realized by the slide moved against the mount.

SUMMARY OF THE INVENTION

It is an object of the present invention to provide a reliable and space-saving device of the aforementioned kind that can be handled comfortably and quickly for mounting and demounting of the mount and that ensures a reliable securing action of the mounted position of the mount on the support.

In accordance with the present invention, this is achieved in that the mount has a threaded receptacle for the screw and the screw is a component of the mount, in that the actuating end of the screw has correlated therewith a stationary support surface on the support, and in that, in the securing position, the actuating end of the screw is supported on the support surface of the support and secures the mounted position of the mount on the support.

The special feature of the invention resides in that the threaded receptacle of the screw provided for securing the mount is not located within the support or in a slide mounted on the support but is provided within the mount itself. According to the invention, the mount and the screw for securing the mount form of pre-assembled module. The support itself only must provide a stationary screw support surface on which, in the locking position, the actuating end of the screw is supported. During mounting, the screw is screwed into the mount as far as possible until the shoulder on the mount engages behind the counter shoulder provided on the support. Subsequently, for securing this mounting position of the mount on the support, the screw is unscrewed from the mount to such an extent that, as mentioned above, its actuating end rests against the screw support surface on the support. Not the inner end of the screw, as in the aforementioned prior art devices, but the opposed actuating end of the screw secures the engagement of the mount shoulder at the counter shoulder on the support.

BRIEF DESCRIPTION OF THE DRAWING

In the drawing:

FIG. 2 is mounted but not yet secured by the screw;

DESCRIPTION OF THE PREFERRED EMBODIMENTS

Figure 3:
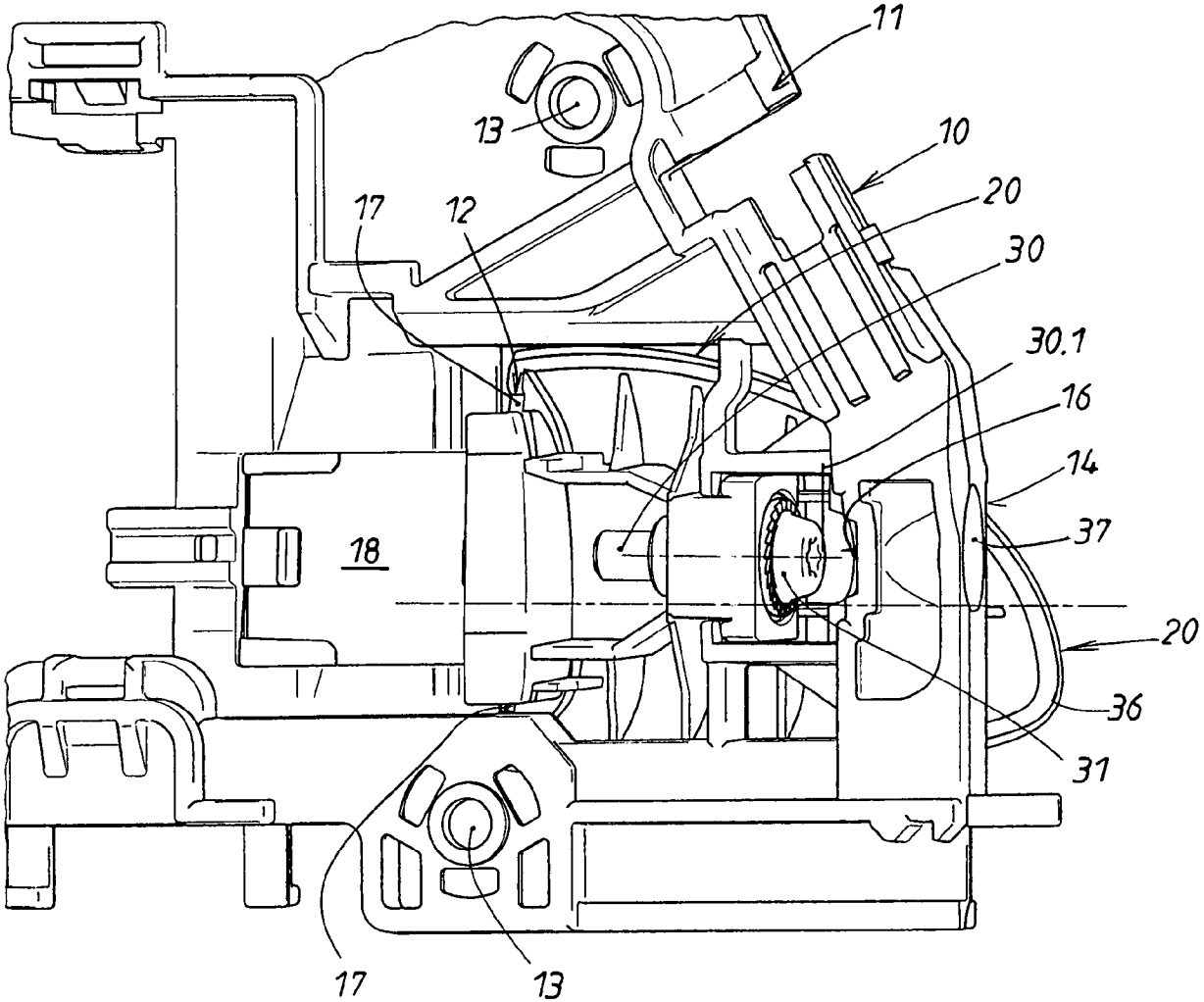
FIG. 3 is a support on which the mount according to FIG. 1
Figure 11:
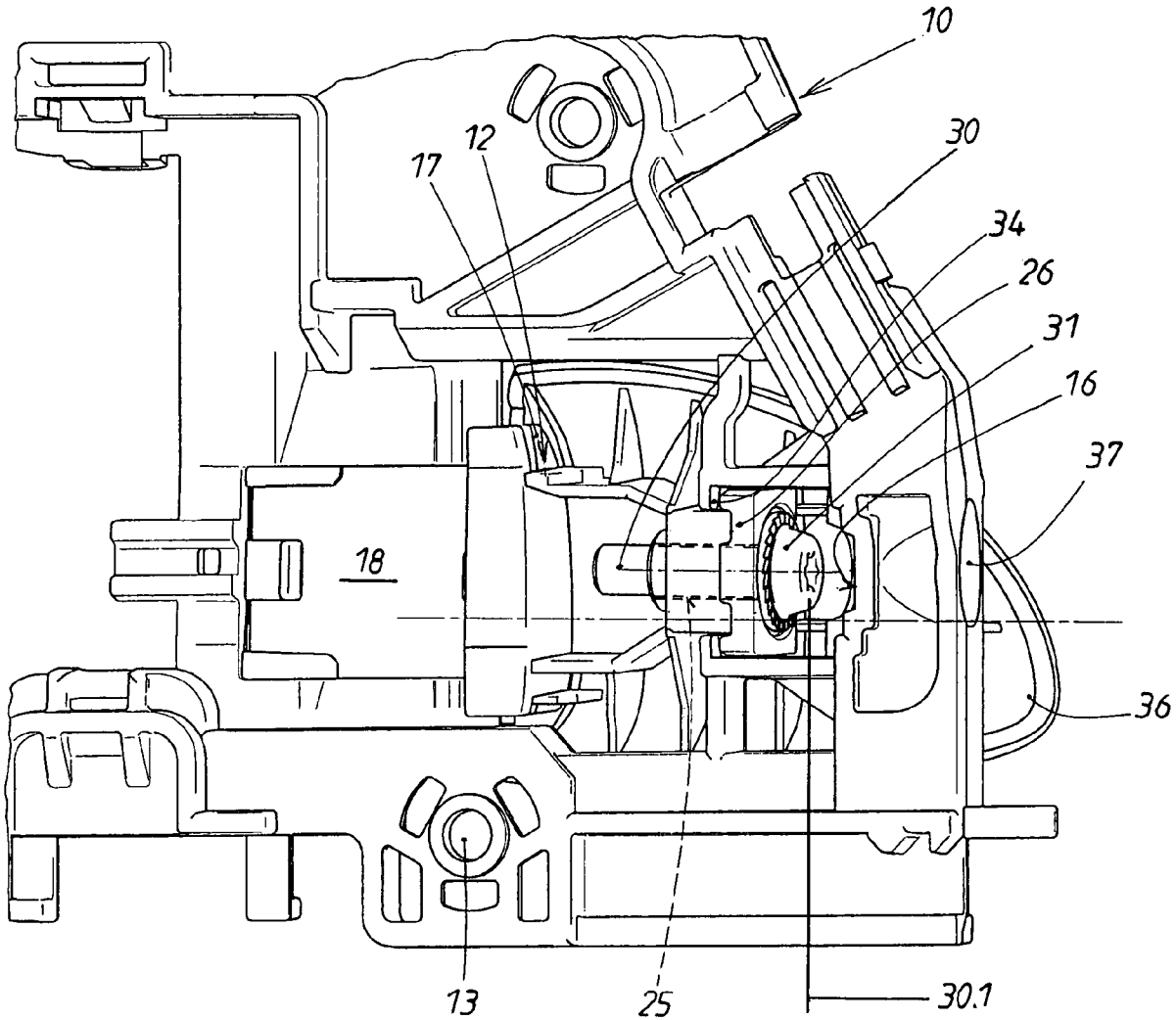
FIG. 11 shows in a view analog to FIG. 3 the yet unsecured position of the mount on the support where the screw is still in the release position so that the mount can still be inserted into and removed from the support.
Figure 12:
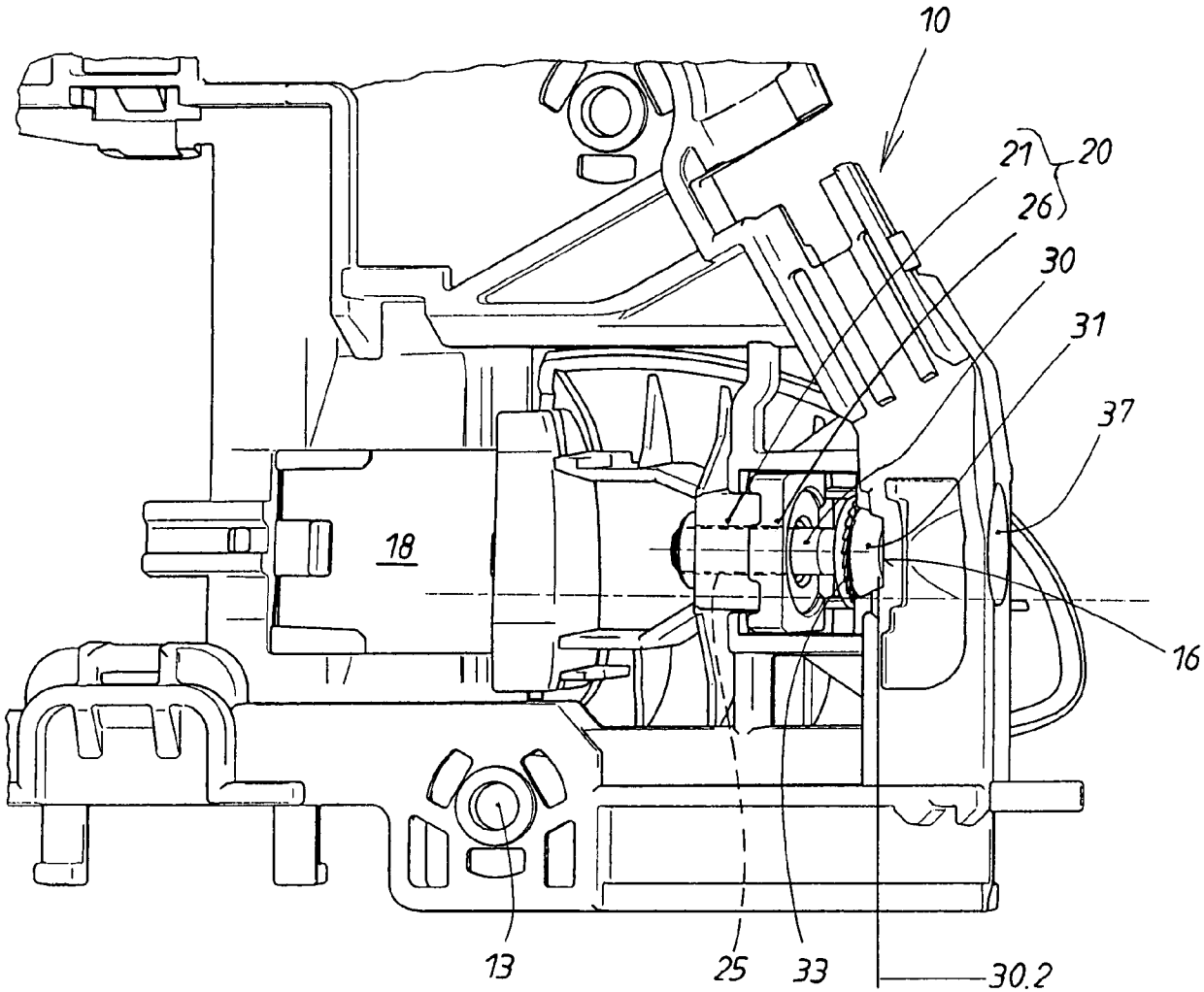
FIG. 12 shows in an illustration corresponding to FIG. 11 the securing position where the screw has been turned within the mount to such an extent by a screwing tool (not illustrated) that its actuating end is supported on the support surface provided on the support.

Only one end of the support 10 of the device is shown in FIG. 3 and FIGS. 11, 12, respectively, for both embodiments. In both embodiments, the supports 10 are identical; the backside 11 of the support 10 mounted on the inner side of a door, not shown, is illustrated in the drawings. The fastening locations 13 for fastening means for fastening the door and the support 10 to one another are illustrated. The handle 15 for actuating a lock provided on the door is illustrated in dash-dotted lines only in FIG. 5. The handle 15 is provided at the front side of the support 10 and is not illustrated in more detail; it is accessible from the exterior of the door for manual actuation. The elements that upon actuation of the handle 15 act on the lock pass through a cutout 18 provided within the support 10. These elements of the handle 15 are not illustrated in FIGS. 3, 11, and 12.

Figure 2:
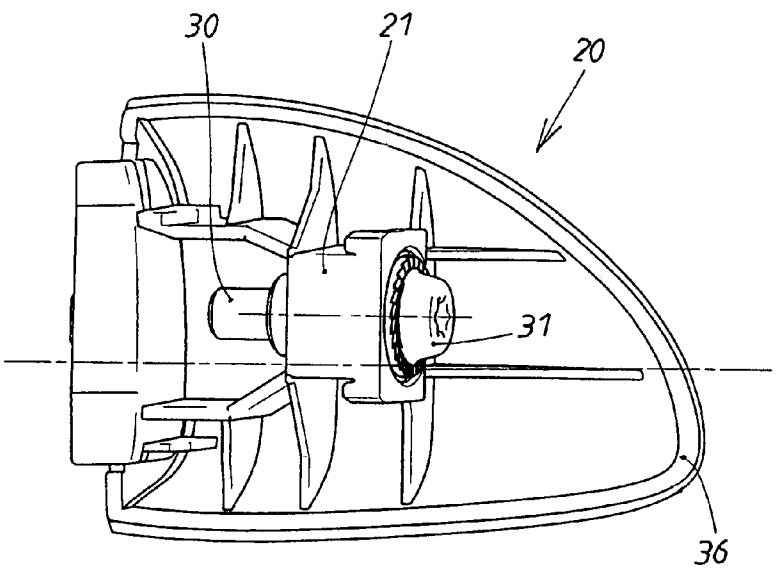
FIG. 2 shows the bottom side of the mount illustrated in FIG. 1.

Such a handle 15 can also be mounted on the support 10 at a later time, i.e., after the support 10 has been mounted on the door, from the outer side of the door through openings in the outer door panel. In this connection, one end of the handle is coupled with a bearing provided on the support while the other end of the handle has the aforementioned elements that are to be positioned in the cutout 18 of the support 10. he cutout 18 has a sufficiently large size so that in addition to the mounted elements of the handle a mount 20 can be mounted. It will suffice to explain the configuration and the function of the mount with the aid of the second embodiment of FIGS. 4 through 10 because this second embodiment differs from the embodiment of FIGS. 1 and 2 only in that the mount has a separate stabilization member 26 on the mount housing 21; this area is of a monolithic configuration in the first embodiment of the mount. The stabilization member 26 reinforces the mount.

Figure 6:
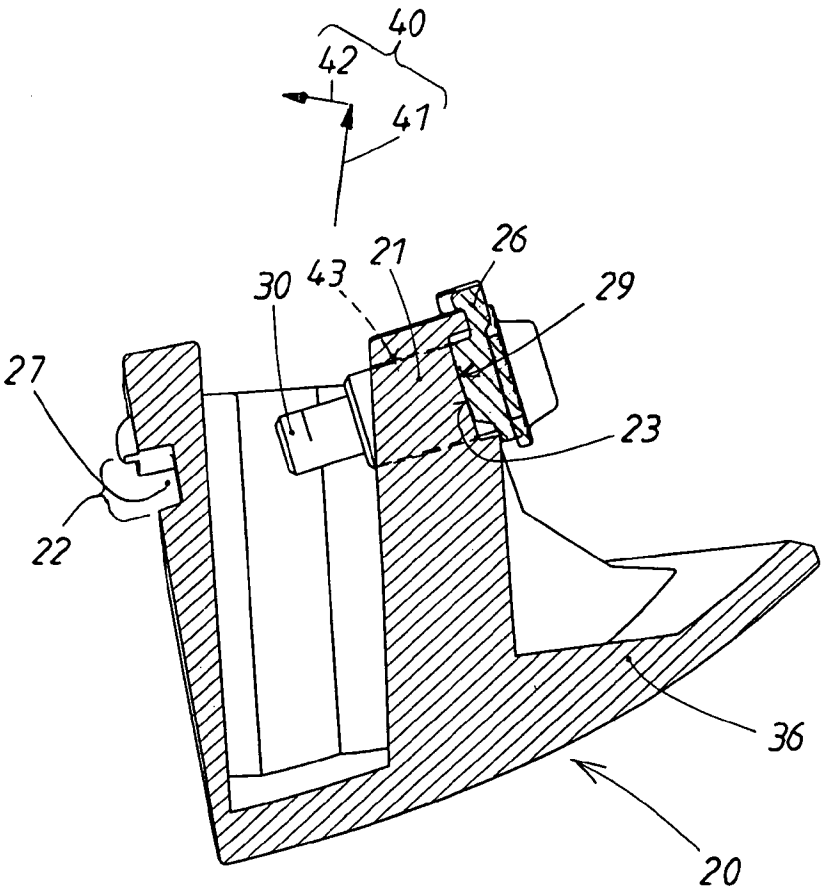
FIG. 6 is a longitudinal section of the mount of FIG. 4 along section line VI-VI.
Figure 10:
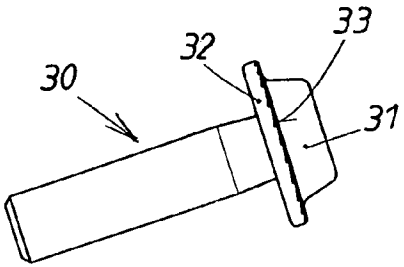
FIG. 10 shows a screw used in both embodiments for securing the mounted position of the mount on the support.
Figure 8:
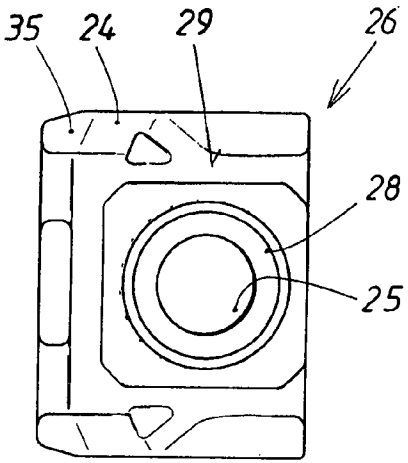
FIG. 8 is an end view of the stabilization member of FIG. 7 in the direction of arrow VIII.

As can be seen best in FIG. 6, the mount (decoy) 20, as already mentioned, is comprised of a stabilization member 26 that is produced separately and receives the screw 30 illustrated in FIG. 10 and is inserted into a bore of the separately produced mount housing 21. The mount 20 has a threaded receptacle 25 for the screw 30 illustrated in FIG. 10. While in the first embodiment of FIGS. 1 and 2 this threaded receptacle is a component of the mount housing 21, in the second embodiment, illustrated in FIGS. 7 through 9, it is arranged in a bushing 28 of the stabilization member 26.

Figure 4:
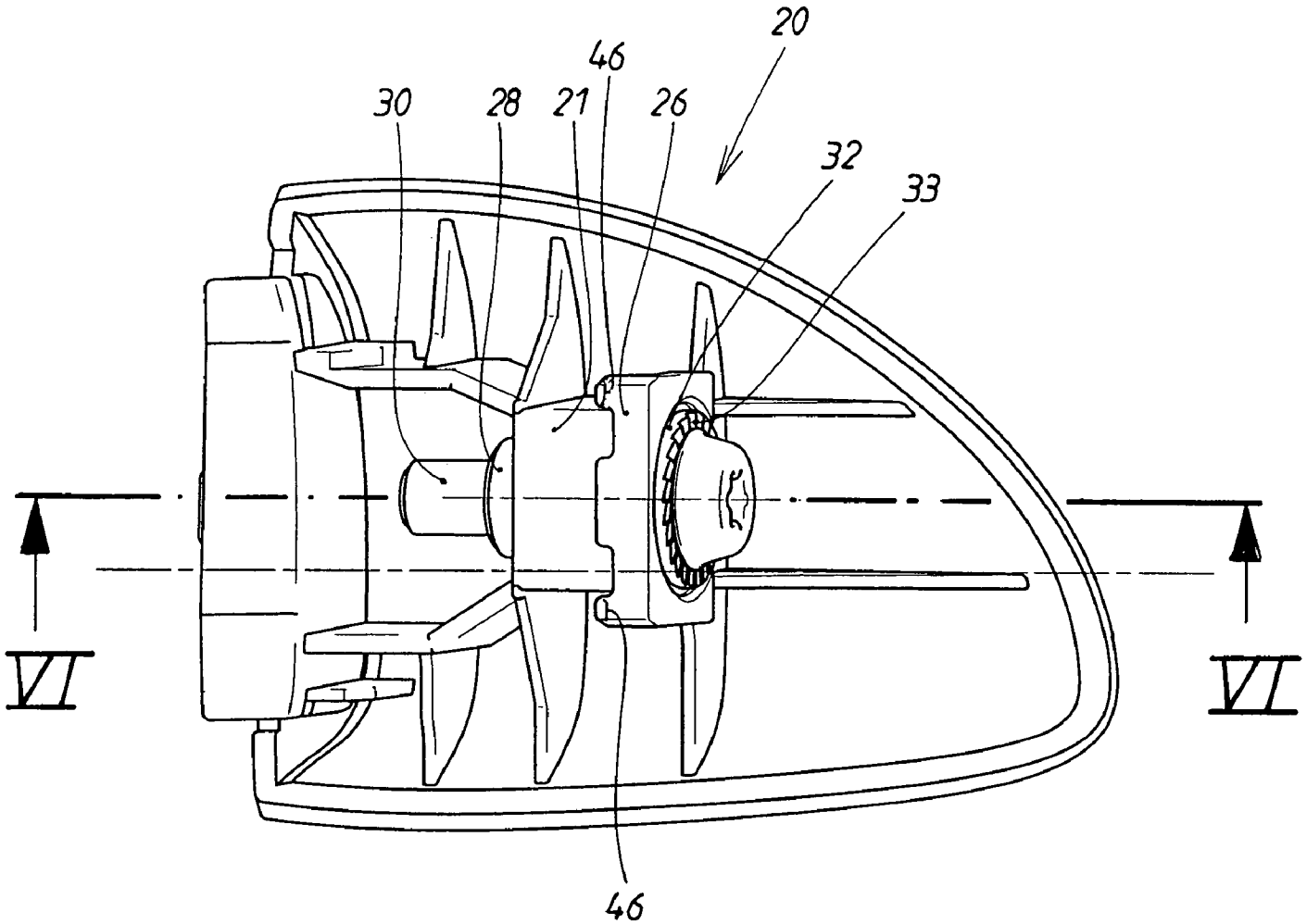
FIG. 4 shows, in a view analog to FIG. 2, a second embodiment of the mount of the device according to the invention.
Figure 7:
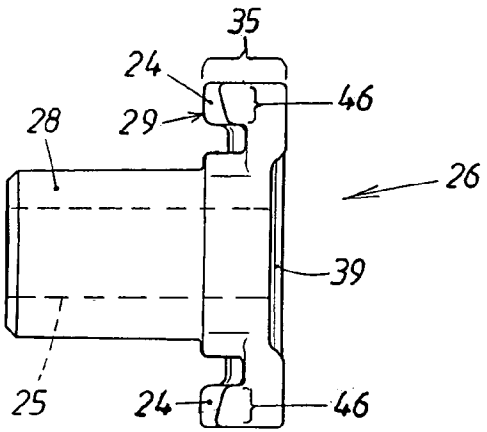
FIG. 7 shows a stabilization member of the mount illustrated in FIGS. 4 through 6 in a plan view.

The stabilization member 26 has the following configuration. At the outer end of the bushing 28 an end member 35 that is all around widened like a flange is provided that, upon insertion of the stabilization member 26 into a bore 43 of the mount housing 21 for forming a preassembled unit, will abut by means of an inner profile 29 according to FIG. 9 a counter profile 23 on the mount housing 21. This bore 43 is illustrated in dashed lines in the section view of FIG. 6. In the insertion position of the stabilization member 26, the stabilization member 26 projects with projections 46, illustrated in FIG. 7, from the end member 35 on opposed sides of the mount housing 21. This is also illustrated in FIG. 4. Slanted surfaces 24 that can be seen particularly well in FIG. 7 are provided at this location; as will be explained in more detail in the following, these slanted surfaces 24 cooperate with slanted counter surfaces 34 of the support 10 in the securing position.

Figure 1:
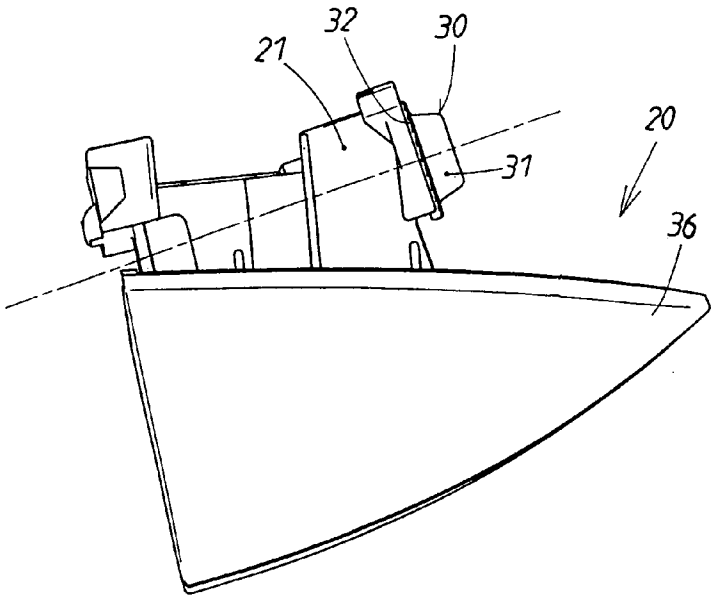
FIG. 1 shows a side view of a first embodiment of the mount of the device according to the invention before being mounted on the support, wherein the mount does not have a lock cylinder to be actuated by a key and is only a mount decoy without lock cylinder.
Figure 5:
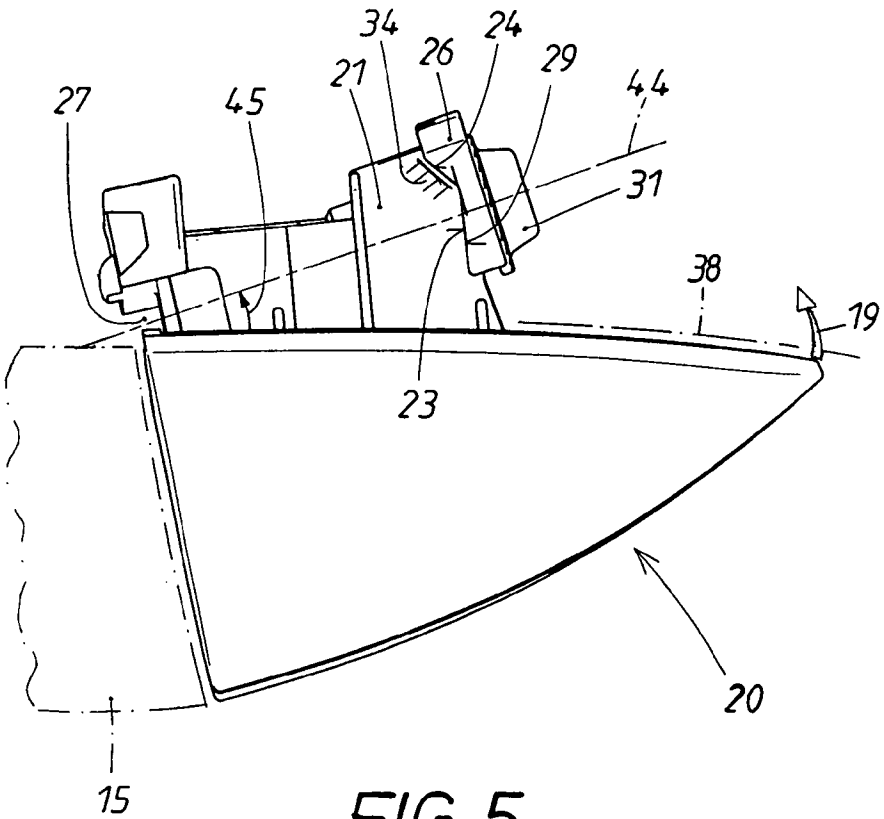
FIG. 5 shows in a view analog to the illustration of FIG. 1 a side view of the mount of FIG. 4.

The module 21, 26, 30 of the second embodiment of FIG. 6 and the module 21, 30 of the first embodiment according to FIG. 1 are mounted from the exterior side of the door through an opening in the outer door panel in the cutout 18 of the support 10. This can be realized by an assembling movement 40 that has two movement phases illustrated by arrows 41, 42 in FIG. 6. In the first movement phase 41, the mount is inserted substantially perpendicularly to the door plane; subsequently, a movement phase 42 moves the inserted mount 28 within the support 10 in a direction perpendicular to the first movement phase 41. During this assembling movement 40, the shoulders 22 provided on the mount 20 engage counter shoulders 12 on the support 10; the counter shoulders 12 are only schematically illustrated in FIGS. 3 and 11. While the shoulders 22 are formed by a groove 27 in the mount housing 21 provided with inner surfaces, as illustrated in FIG. 6, the counter shoulders 12 are in the form of ribs 17 formed on the support 10. FIG. 3 and FIG. 11, respectively, show the end position of the mount 20 after completion of mounting within the support 10. The head 36 of the housing illustrated in FIG. 5 and FIG. 6 is now positioned on the exterior side of the door in front of the door panel 38 illustrated in FIG. 5 in dashed lines. Adjacent to the housing head 36 of the mounted mount 20, a portion of the lock of the handle 15 is positioned as illustrated in FIG. 5 in dashed lines. In FIG. 5, the position of the support 10 is not shown.

Upon completion of assembly according to FIGS. 3 and 11, the screw 30 is screwed into the threaded receptacle 25 in the mount housing 21 or in the stabilization member 26 to the maximum extent. This is indicated in FIG. 3 and FIG. 11 by the auxiliary line 30.1; this is referred to as the release position of the screw 30. As shown in FIG. 10, the screw 30 is provided with a flange 32 in the area of its actuation end 31. The release position 30.1 can be secured in that the flange 32 is moved into a flange receptacle 39 in the widened end member 25 of the stabilization member 26 or the mount housing 21 and rest against the receptacle 39.

In the mounted position of the mount 20, the actuation end 31 of the screw 30 that is in the release position 30.1 is aligned with a cutout 37 provided within the support end 14 (FIG. 3) and providing an access to the actuation end 31.

From the narrow side of the door where a hole is provided, a screwing tool can be inserted into the tool receptacle in the actuation end 31 of the screw 30. By means of the screwing tool, the screw 30 is then moved out of the mount 20 in the direction toward the support end 14. On the support 10, a stationary screw support surface 16 is provided that faces the screw 30. The movement of the screw 30 in the outward direction will end when the screw 30 abuts the screw support surface 16 as shown in FIG. 12. The unscrewed screw 30 is now in the locking position for securing the mount in the securing position; the locking position of the screw 30 is indicated by the auxiliary line 30.2. In the present configuration, the stop function is realized in that the actuation end 31 itself will come to rest against the screw support surface 16. The afore described flange 32 rests annularly against the surface 16. This flange 32 is provided with a lock toothing 33 illustrated in FIG. 10 that digs or penetrates into the support surface 16 of the support 10 in the locking position 30.2 shown in FIG. 12. Since the lock toothing 33 has a sawtooth profile, the return movement of the screw 30 out of its securing position 30.2 is made significantly more difficult. In this way, a particularly reliable locking of the mount 20 in its mounting position in the support 10 is provided.

According to the prior art, a worker who must mount such devices on doors or flaps of vehicles, is used to rotate the tool in the clockwise direction in order to transfer the screw for securing the mounted mount 20 in the securing position. However, according to the invention, the screw, as described above, is moved out of the mount 20 with its actuating end 31 during this securing action. In the case of a conventional right-handed thread of the prior art, the screw 30 therefore would have to be rotated in the counter-clockwise direction. The worker therefore would be required to retrain mounting of the device according to the invention and rotate the screwing tool in the opposite direction. This would be confusing to a worker when, at times, he would have to mount also prior art devices in between. For this reason, it is proposed to provide the screw 30 and the threaded receptacle within the mount as so-called left-handed threads. In this case, the worker can actuate the screwing tool in the clockwise direction as usual because the screw will then be axially moved out of the mount 20. This has the advantage that the worker must not pay attention whether the device to be mounted is configured according to the invention or according to the prior art.

Figure 9:
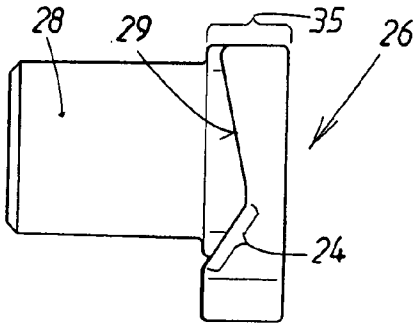
FIG. 9 is a side view of the stabilization member illustrated in FIGS. 7 and 8 in the direction of arrow IX of FIG. 7.

When the mount 20 is mounted, the slanted surface 24 shown in FIGS. 7 and 9 of the end member 35 of the stabilization member 26 and the slanted counter surface 34 of the support 10 cooperate. In the securing position 30.2, there is not only the tightening action of the stabilization member 26 on the counter surface and of the flange 32 of the actuating end 31 on the support surface 16 but, in addition, a tightening or pulling action will result that is illustrated in FIG. 5 by arrow 19. In FIG. 5, the position of the slanted counter surface 34 is indicated in dashed lines. Upon tightening, the slanted surface 24 moves against the stationary slanted counter surface 34 of the support 10 and generates a torque causing the aforementioned pulling action 19 that pulls the mount 20 toward the support 10 and against the outer door panel 38 that is illustrated in FIG. 5 in dash-dotted lines. The screw axis 44 of the screw 30, illustrated in FIG. 5 by a dashed line, has an angled position 45 relative to the support 10 that extends in this area substantially parallel to the outer door panel 38 (illustrated in FIG. 5 in dash-dotted lines).

While specific embodiments of the invention have been shown and described in detail to illustrate the inventive principles, it will be understood that the invention may be embodied otherwise without departing from such principles.

What is claimed is:

1. A device for actuating a lock on a vehicle door, the device comprising:

a support configured to be mounted on an interior of a vehicle door;

a mount and a threaded receptacle in the mount for a threaded end of a screw;

the screw and the mount forming a preassembled module to be mounted as a whole from an outer side of the door at the support attached to the interior of the door;

for mounting the module, the screw being screwable in the mount between two end positions by means of a rotary tool which acts on an actuating end of the screw, wherein the screw protrudes out of the module, wherein a first of the two end positions is a securing position in which the screw is screwed to a maximum extent out of the mount until the actuating end of the screw rests against a support surface of the support and secures the assembly position of the module in the support, and wherein a second of the two end positions is a release position in which the screw is screwed to a maximum extent into the mount and the actuating end of the screw is arranged at a distance from the support surface, such that the module is separated from the support.

2. The device according to claim 1, wherein the support has a support end provided with an access for the actuating end of the screw and wherein the screw support surface of the support is in the area of the access.

3. The device according to claim 2, wherein, after the support has been attached to a vehicle door, the access is accessible via a hole provided in a narrow side of the vehicle door.

4. The device according to claim 1, wherein the mount has at least one groove forming the at least one shoulder of the mount, wherein the support has at least one rib forming the at least one counter shoulder, and wherein the at least one rib engages the at least one groove in the mounting position of the mount.

5. The device according to claim 4, wherein the support has a cutout, and wherein the at least one rib is arranged on opposed sides of the cutout, wherein the at least one shoulder is arranged on opposed sides of the mount.

6. The device according to claim 5, wherein the cutout is configured to enable mounting and demounting of the mount and a handle to be mounted on the support adjacent to the mount from an exterior side of a vehicle door.

7. The device according to claim 1, wherein the mount has a stabilization member in an area where the actuating end of the screw is located, wherein the support has counter surfaces oriented to face the screw support surface of the support, wherein in the locking position of the screw the stabilization member is supported on the counter surfaces.

8. The device according to claim 7, wherein the threaded receptacle of the mount is arranged in the stabilization member.

9. The device according to claim 8, wherein the stabilization member comprises a bushing and wherein the threaded receptacle is arranged in the bushing, wherein the mount has a mount housing provided with a bore, wherein the bushing is inserted into the bore of the mount housing to form a preassembled unit.

10. The device according to claim 9, wherein the stabilization member has an inner profile facing the mount housing, wherein the mount housing has a counter profile, wherein the inner profile and the counter profile engage one another at least in the release position of the screw.

11. The device according to claim 10, wherein the inner profile has at least one slanted surface and wherein the counter surfaces of the support are slanted and interact with the at least one slanted surface of the inner profile, wherein in the locking position of the screw the at least one slanted surface of the inner profile rests against the counter surfaces of the support and creates a torque pulling the mount against the support.

12. The device according to claim 11, wherein the shoulder and counter shoulder provide a rocking support for the torque acting on the mount.

13. The device according to claim 11, wherein the bushing of the stabilization member has a widened end member and wherein the inner profile is provided on the end member, wherein the inner profile and the counter profile of the mount housing rest against one another in the preassembled unit.

14. The device according to claim 13, wherein the end member has projections that, in the preassembled unit, project on opposed sides past the mount housing, wherein the at least one slanted surface of the inner profile is located on the projections.

15. The device according to claim 1, wherein the screw has a flange at the actuating end and wherein the flange in the locking position of the screw is supported on the screw support surface of the support.

16. The device according to claim 15, wherein the flange has a flange side facing the screw support surface, wherein the flange side has a lock too thing that digs into the screw support surface in the locking position of the screw.

17. The device according to claim 1, wherein the threaded receptacle has a left-handed thread.

18. The device according to claim 1, wherein the mount is a mount with a lock cylinder or a lock decoy without lock cylinder.

* * * * *